United States Patent [19]

Schaafsma

[11] 4,315,390

[45] Feb. 16, 1982

[54] WALLBOARD CORNERS

[76] Inventor: Michael Schaafsma, 2030 La Paloma, Tujunga, Calif. 91042

[21] Appl. No.: 157,284

[22] Filed: Jun. 6, 1980

[51] Int. Cl.[3] ..... E04B 1/38

[52] U.S. Cl. ..... 52/288; 52/255

[58] Field of Search ..... 52/255, 287, 288, 468, 52/717, 417

[56] References Cited

U.S. PATENT DOCUMENTS

| | | | |
|---|---|---|---|
| 1,634,862 | 7/1927 | Yoder . | |
| 1,653,656 | 12/1927 | Pfistner . | |
| 1,800,609 | 4/1931 | Drake . | |
| 2,114,044 | 4/1938 | Bonnell | 52/288 |
| 2,138,470 | 11/1938 | Bischof | 52/277 X |
| 2,687,558 | 8/1954 | Dunlap . | |
| 2,862,264 | 12/1958 | Perna | 52/288 |
| 3,047,112 | 7/1962 | Tvorik et al. . | |
| 3,090,087 | 5/1963 | Miller | 52/417 X |
| 3,093,934 | 6/1963 | Underhill | 52/417 X |
| 3,109,207 | 11/1963 | Cooper . | |
| 3,444,657 | 5/1969 | Swanson | 52/417 |
| 3,604,169 | 9/1971 | Smith | 52/288 |
| 3,760,544 | 9/1973 | Hawes et al. | 52/468 |
| 3,989,397 | 11/1976 | Baker | 52/288 X |
| 4,067,155 | 1/1978 | Ruff et al. | 52/468 X |
| 4,157,271 | 6/1979 | Moore | 52/288 X |

FOREIGN PATENT DOCUMENTS

| | | | |
|---|---|---|---|
| 582857 | 8/1933 | Fed. Rep. of Germany | 52/255 |
| 392025 | 9/1965 | Switzerland | 52/255 |
| 920803 | 3/1963 | United Kingdom | 52/417 |

*Primary Examiner*—Alfred C. Perham

*Attorney, Agent, or Firm*—Poms, Smith, Lande & Rose

[57] ABSTRACT

Corner strips are provided for positioning between perpendicularly-disposed wallboard sheets to effect a curvilinear transition between the sheets. In one embodiment, a longitudinally-extending and transversely concave or inwardly curved rigid member is adapted for positioning between the sheets with the sheets perpendicularly-disposed in mutually-abutting relation. The concave member is held in the corner by an arrow-like member engaging putty-like material placed in the corner. In another embodiment, a longitudinally-extending and transversely convex or outwardly-curved rigid member is adapted for positioning between the sheets with the sheets perpendicularly-disposed in spaced-apart relation. The convex member is held to the sheets by a pair of open channels engaging the edges of the sheets. In both embodiments, wallboard tape, bonded to the concave and convex members, overlaps the wallboard sheets and effects a smooth transition between the sheets and the corner strip members. The concave and convex members may be made of aluminum or plastic material.

13 Claims, 5 Drawing Figures

Fig. 2.
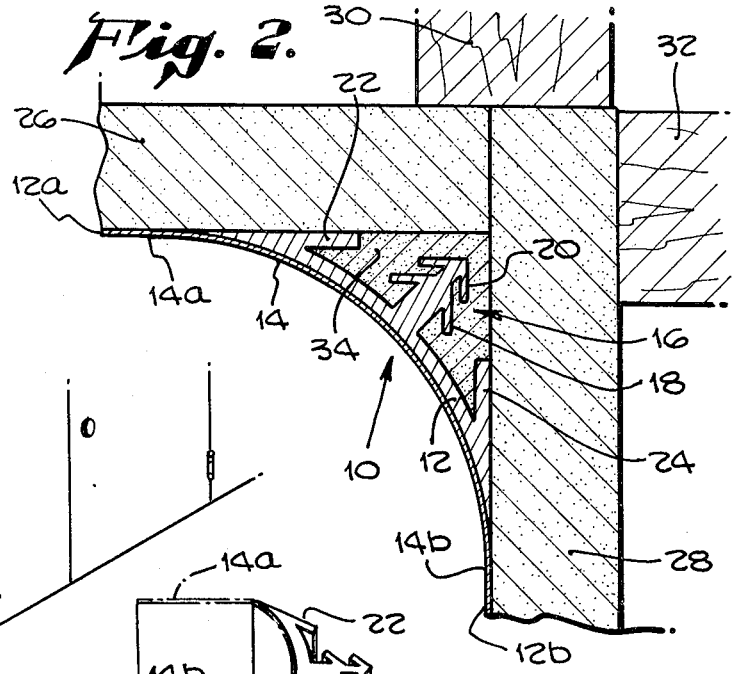
Fig. 1.
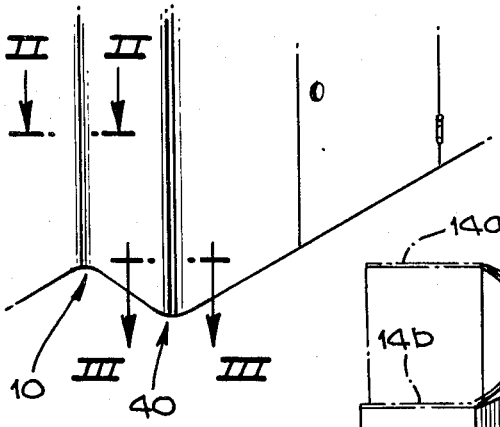
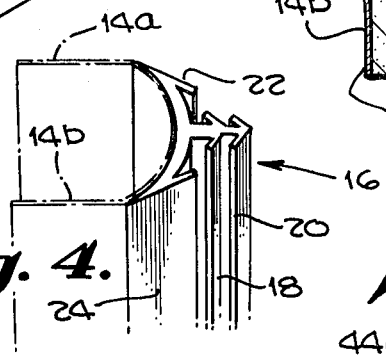
Fig. 4.
Fig. 5.
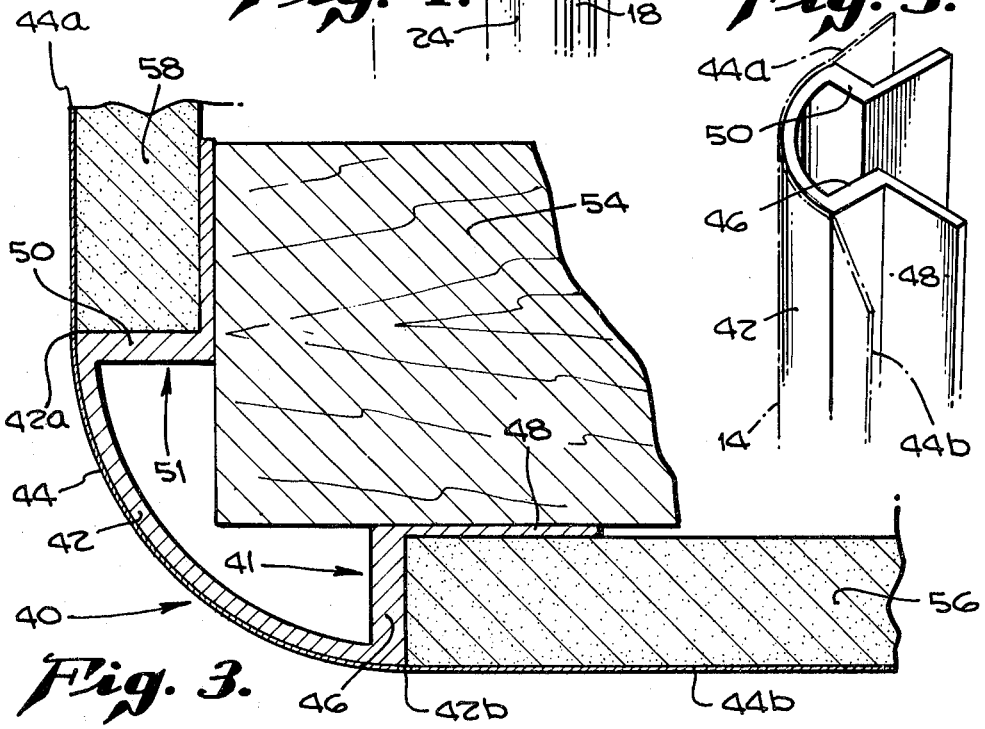
Fig. 3.

WALLBOARD CORNERS

FIELD OF THE INVENTION

The present invention in general relates to wallboard corner strips and, in particular, relates to concave and convex corner strips for use with sheets of drywall material.

BACKGROUND OF THE INVENTION

Wallboards of drywall material are finding increased use in residential and commercial construction. As compared to other types of wall construction, such as lath and plaster, walls can be much more quickly and economically constructed of drywall material. However, because drywall material is fabricated in large, thin sheets, rooms constructed of drywall material have square corners. A typical drywall corner comprises two perpendicular drywall sheets nailed through a metallic corner strip to a frame member. A thick layer of a putty-like material, commonly referred to as drywall mud or topping compound, is then placed over the nailed areas of the drywall. When this material drys, the corner is sanded down to provide the corner with a smooth finish. These present drywall construction techniques and materials make implementation of anything but a square drywall corner very difficult.

The artistic capabilities of drywall construction would be greatly enhanced if curved drywall corners of both the concave and convex variety could be quickly and easily fabricated. Curved drywall corners would find wide use in both domestic and commercial drywall installations. The prior art generally does not disclose any corner strip for drywall sheets that provides a curved corner. Consequently, curved corners are very expensive to fabricate with present drywall construction techniques, as each corner must be hand made. While the prior art discloses slightly rounded drywall corner strips, no corner strips for drywall construction have been disclosed having a more substantial radius on the order of several inches.

Furthermore, as discussed above, the corner strips providing the square corner have to be subsequently covered with topping compound as part of the process of finishing the corner. The drywall corners of the prior art are not generally prefabricated with drywall tape, which would allow the quick finishing of a corner by simply folding the tape onto the drywall sheets and then lightly coating the tape with the compound. Such a prefabrication would greatly increase the speed of the drywall corner production.

A further limitation of the drywall corners found in the prior art is that they generally are designed to affix the drywall sheets to a frame member by nailing and the like. The nailing process consumes valuable time and the speed of installation of drywall corners would be greatly increased if the nailing could be eliminated. In particular, a corner unit which could be simply glued to the drywall sheet would also greatly increase the speed of fabrication of drywall corners.

Finally, most of the corner strips used in drywall construction are fabricated of sheet metal or the like, which can involve a stamping process. A corner strip of inexpensive material such as plastic aluminum, which could be fabricated by less expensive techniques such as extruding, would also help reduce construction costs and would therefore enhance the use of drywall material for room construction.

Accordingly, it is the principal object of the curved corners in rooms constructed of wallboard material such as drywall.

It is another object of this invention to allow both concave and convex corners to be constructed in installations utilizing drywall material.

It is still another object of this invention to allow curved corners to be created simply and inexpensively.

It is a further object of this invention to allow the quick and rapid installation of curved corners in rooms constructed of drywall material.

It is another object of this invention to eliminate the use of nails and the like to affix corner strips to drywall sheets.

It is yet another object of this invention to provide a curved drywall corner prefabricated with drywall tape, thereby speeding the installation of the corner strip and eliminating the use of nails and the like to affix the strip to a frame member.

It is still another object of this invention to provide a curved corner strip for use with drywall and the like which would provide a substantial radius.

It is another object of this invention to provide a corner strip which may be economically constructed of extruded material.

SUMMARY OF THE INVENTION

The present invention, in a broad aspect, provides corner strips for two perpendicularly-disposed wallboard sheets. The corner strips each include a rigid curved member positioned between the sheet to effect a curvilinear transition from one of the sheets to the other of the sheets; anchoring members to position the rigid member against the sheets; and, tape, bonded to the rigid member, to overlap the sheets and achieve a smooth transition between the rigid member and the sheets.

In accordance with one feature of the invention, the rigid member is a longitudinally-extending and transversely concave or inwardly-curved member having longitudinal feathered edges for abutting relation with two sheets disposed perpendicularly in abutting relation. The concave member is attached to putty-like material placed against the sheets by an arrow-like protrusion extending towards the corner formed by these sheets and piercing the putty material. A piece of tape extending the length of the concave member and past the feathered edges overlaps the sheets after the installation of the corner member. Thus, the concave member is held by the arrow-like members against the putty-like material placed in the corner, with the feathered edges and the tape effecting a smooth transition between the concave member and the sheets.

In accordance with another feature of the invention, the concave member can include a pair of supporting plates which extend inwardly from the feathered edges towards the corner and longitudinally along at least a part of the concave member. The supporting plates are parallel to the sheets and the positioning of the plates against the sheets centrally positions the concave member in the corner.

In accordance with another feature of the invention, the arrow-like member engaging the putty in the corner can include a pair of arrow-like protrusions extending longitudinally over substantially the entire length of the concave member to affix the member to the putty.

In accordance with another feature of the invention, the wallboard sheets can be sheets of drywall material, the putty-like material can be drywall topping compound, and the tape can be preglued drywall tape attached to the concave member, whereby the concave member is positioned between the two perpendicularly-disposed drywall sheet forming the corner. The corner is filled with the topping compound, with the arrow-like members anchoring the concave member to the compound and with the drywall tape smoothly lapping the edges of the concave member to the sheets.

In accordance with yet another feature of the invention, the rigid member can comprise a longitudinally-extending and transversely convex or outwardly-curved member adapted for positioning between the sheets with the sheets perpendicularly disposed in spaced-apart relation. The convex member can be attached to the sheets by a pair of open channels extending longitudinally along the convex member. The open channels are positionable beneath the edges of the drywall sheets to anchor the convex member thereto. Tape is provided on the convex member to overlap the sheets to achieve a smooth transition between the convex member and the sheets.

In accordance with a further feature of the invention, the open channels at each side of the convex member can each include a first member perpendicular to the longitudinal edges of the convex member and a second member perpendicular to the edge of the first member. The first and second members thereby form two right-angle open channels which receive the edge portions of two drywall sheets, with the second member being positioned beneath its respective sheet, and with the first member having a width of approximately equal to the thickness its respective sheet. In this manner, the extreme edges of the convex member is immediately adjacent to the outer surfaces of the sheets, with the tape providing a smooth transition therebetween.

In accordance with another feature of the invention, the concave or convex strips may be easily extruded with plastic or aluminum material.

Other objects, features, and advantages of the present invention will become apparent from a consideration of the following detailed description and from the accompaning drawings.

BRIEF DESCRIPTION OF THE DRAWINGS

FIG. 1 shows concave and convex drywall corners formed by the two embodiments of a corner strip of the present invention;

FIG. 2 is a cross sectional view of the concave corner in FIG. 1 formed with the concave corner strip embodiment of the present invention, taken through the plane II—II;

FIG. 3 is a cross sectional view of the convex corner in FIG. 1 formed with the convex corner strip embodiment of the present invention, taken through the plane III—III;

FIG. 4 is an elevational view of a concave corner strip according to the present invention; and FIG. 5 is an elevational view of a concave corner strip according to the present invention.

DETAILED DESCRIPTION

Referring more particularly to the drawings, FIGS. 4 and 5, respectively, show a concave and a convex embodiments 10 and 40 of drywall corners according to the present invention. As explained hereinafter, each corner strip 10 and 40 comprises a curved rigid member 12 and 42, plus provisions for attaching the curved member 12 and 42 to two perpendicularly-disposed sheets of wallboard without the need for nails or the like, and wallboard tape 14 and 44 attached to the rigid members 12 and 40 to allow a smooth lapping of the corner onto the outer surface of the wallboards.

The corner strips 10 and 40 of the present invention may be fabricated simply and inexpensively and installed very quickly without the use of through-nailing or the like. Furthermore, unlike those devices of the prior art, the corner strips 10 and 40 allow curved corners having a relatively large radius to be achieved in rooms utilizing wallboard material. As such, much architectural and artistic flexibility may be achieved in the construction of rooms from wallboard material, thereby making wallboard attractive for a wider range of uses.

FIGS. 2 and 1, respectively, show cross-sectional and installation views of a concave drywall corner 10 according to the present invention. As shown therein, the concave or inwardly-curved drywall corner strip 10 includes a longitudinally-extending and transversely concave member 12. The concave member 12 is positioned between two wallboards 26 and 28 of drywall or plasterboard material or the like. The wallboards 26 and 28 mutually abut and are attached to a pair of wall frame members 30 and 32 by nails or the like. As shown in FIG. 4, the ends **12*a* and 12*b* of the concave member 12 are feathered to a very small thickness for a smooth transition onto their respective wallboards 26 and 28**.

Attached to the outer surface of the concave member 12 is a strip of preglued wallboard tape material such as drywall tape 14. The tape 14 completely covers the outer surface of the concave member 12 and has portions **14*a* and 14*b* which overlap the wallboards 26 and 28. The overlapping portions 14*a* and 14*b* are glued or otherwise bonded to the wallboards 26 and 28 after the corner strip 10 has been installed. After such gluing, the strips are sanded down to achieve a smooth transition between the wallboards 26 and 28 and the corner strip 10**.

The concave corner strip 10 is centrally positioned within the corner formed by the abutting wallboards 26 and 28 by a pair of supporting plates 22 and 24 extending inwardly toward the corner from the feathered edges **12*a* and 12*b* of the concave member 12. These supporting plates 22 and 24 are mutually at right angles and are designed for parallel positioning against the wallboards 26 and 28. Accordingly, when the plates 22 and 24 are positioned against the wallboards 26 and 28, the corner strip 10 is centrally positioned within the corner formed by the wallboards 26 and 28**. Such a novel-positioning apparatus is not generally disclosed by the prior art corner strips.

The concave corner strip 10 is affixed to the wallboards 26 and 28 by means of an arrow-like projection 16 extending rearwardly from the concave member 12 into the corner formed by the wallboards 26 and 28. As shown in FIG. 2, to install the strip 10, the corner created by the wallboards 26 and 28 is filled with a putty-like material 34 such as drywall topping compound, or "mud". The arrow-like projection 16 has two V-shaped members 18 and 20 which are designed for insertion into the compound as it is drying. The V-shape of the members 18 and 20 prevents the strip 10 from pulling away from the compound 34 after the mud has set up.

As seen from the foregoing, the installation of the concave corner strip 10 is relatively simple. Once the wallboards 26 and 28 have been affixed to the wall frame members 30 and 32, the corner formed by the wallboards 26 and 28 is filled with the putty-like material 34. As the material begins to set up, the corner strip 10 is pressed down into the putty-like material 34, with the arrow-like member 16 solidly anchoring the strip 10 in the material. The side plates 22 and 24 insure an accurate positioning of the strip 10 in the corner. After the putty material 34 has set up, the overlapping portions of the wallboard tape 14*a* and 14*b* are then folded down against the wallboard sheets 26 and 28. The tape is then covered with putty-like material such as drywall mud. When the material has dried, the material is sanded down, thereby achieving a smooth transition from the concave member 12 to the wallboards 26 and 28. As is apparent, no nails or the like need be used to attach the curved strip 10 to the wallboards 26 and 28, and the entire installation can be done very quickly.

Furthermore, the curved strip 10 contains many features not found in the prior art. First, it is possible to fabricate the corner strip 10 with a relatively large radius for the concave portion, thereby allowing curves of different variety to be achieved. Second, the wallboard tape 14 allows a quick installation of the corner strip 10. Third, the supporting plates 22 and 24 allow an accurate positioning of the corner strip 10. Fourth, the novel anchor member 16 obviates the use of nails or the like to attach the corner strip 10 to the wallboards 26 and 28.

FIGS. 5 and 1, respectively, show cross sectional and installation views of a convex or outwardly-curved corner strip 40 according to the present invention. As shown in FIG. 5, the convex corner strip 40 generally includes a rigid convex member 42, provisions for receiving two perpendicularly-disposed wallboards arranged in spaced-apart relation, and again includes the wallboard tape 44 which overlaps the drywall sheets to effect a smooth transition between the convex member 42 and the wallboards.

FIG. 3 shows the installation of the convex corner strip 40 in more detail. As shown therein, the longitudinally extending and transversely convex rigid corner member 40 is positioned between two wallboard sheets 56 and 58 that attached by nails or the like to a corner framing member 54. The concave member 42 is attached to the wallboards 56 and 58 by two open channels 41 and 51 at the extreme transverse edges 42*b* and 42*a* of the convex member 42. Each of the channels 41 and 51 include a first member 40 and 50 disposed perpendicularly relative to the convex member 42 and a second member 48 and 52 disposed perpendicularly relative to the first member 40 and 50. In this manner, two right-angle open channels are formed receive the edge of the wallboard sheets.

The second member 48 and 52 of each channel 41 and 51 is a relatively thin member designed for positioning between the wallboards 56 and 58 and the corner frame member 54. As the wallboards 56 and 58 are themselves nailed to the corner frame member 54, there is no need for the corner strip 40 to be also nailed to the frame, thereby greatly enhancing the speed of production of the concave corner. The first member 40 and 50 of the channels 41 and 51 has a width approximately equal to the thickness of the edges of the wallboards 56 and 58. Accordingly, the extreme transverse edges 42*b* and 42*a* of the convex member 42 are approximately flush with the outer surface of the wallboards 56 and 58. This allows for a smooth transition between the convex member 42 and the wallboards 56 and 58 after the installation of the convex member 42.

As discussed in conjunction with the concave corner strip 10, the convex corner strip 40 includes a piece of drywall tape 44 extending longitudinally along the entire length of the convex member 42 and overlapping the extreme transverse edges 42*a* and 42*b* thereof. This overlap positions portions of the tape 44*a* and 44*b* over the portions of the wallboards 56 and 58 immediately adjacent the convex member 42. After the corner strip 40 has been positioned beneath the wallboards 56 and 58, the overlapping portions 44*a* and 44*b* are positioned against the wallboards 56 and 58 and putty or the like is applied thereto and allowed to dry. The putty is then sanded down to achieve an unnoticeable transition from the wallboards 56 and 58 to the corner strip 40. As is the case with the concave corner strip 10, the installation of the convex corner strip 40 can be done quickly, especially since no use of nails or the like is required.

The corner strips 10 and 40 of the present invention may be fabricated of a wide range of materials such as aluminum, plastic, or steel. Furthermore, if materials such as aluminum are utilized, the strips 10 and 40 may be simply and economically fabricated by an extrusion process or the like. Also the strips 10 and 40 may be used with a wide variety of wallboard materials such as drywall, plasterboard, plywood, and the like. Additionally, the wallboard tape 14 and 44 used in conjunction with the corner strips 10 and 40 may be any convenient taping material. In particular, the tape may be standard drywall tape if the corner strips 10 and 40 are to be used with drywall sheets to create rounded corners. Also, the putty-like material referred to in conjunction with the concave corner 10, and into which the anchor-like member 16 is positioned, may be any convenient putty material such as drywall topping compound or "mud". Accordingly, the novel corners of the present invention not only allow the creation of convex and concave corners in a simple and efficient manner, but are also adaptable for use with a wide range of materials.

In the foregoing description of the present invention, two alternative embodiments of the invention have been disclosed. It is to be understood that the other mechanical and design variations are within the scope of the present invention. Thus, by way of example and not of limitation, different means could be used to anchor the convex corner in putty-like material; different means could be utilized to position the convex corner between two spaced-apart, perpendicularly-disposed wallboard sheets; means different than supporting plates could be utilized to center the concave corner between two wallboard sheets; and different types of taping arrangements could be utilized on the corner strips to effect a smooth transition between the strips and the wallboard sheets. Accordingly, the invention is not limited to the particular arrangement which has been illustrated and described in detail herein.

What is claimed is:

1. A corner strip for two perpendicularly-disposed wallboard sheets forming a corner, comprising:

means, disposed between said sheets, for effecting a curvilinear transition from one of said sheets to the other of said sheets, said effecting means comprising a longitudinally-extending and outwardly rounded member adapted for positioning between said sheets; and a pair of open channels extending longitudinally along at least a portion of the edges of said rounded member, said channels each comprising a first member perpendicular to said edges of said rounded member and a second member perpendicular to said first member, said first and second members thereby forming a right-angle open channel for receiving the edge of one of said sheets, with said second member being positioned beneath said sheet and with said first member having a width approximately equal to the thickness of the edge of said sheet, whereby the edges of said rounded member are immediately adjacent the outer surfaces of said sheet; and a piece of tape extending the length of said rounded member and overlapping said edges of said sheets, whereby said rounded member is held by said open channels against said sheets, with said tape effecting a smooth transition between said sheets and said rounded member.

2. A corner strip for two perpendicularly-disposed wallboard sheets, comprising:

means, disposed between said sheets, for effecting a curvilinear transition from one of said sheets to the other of said sheets, said effecting means comprising a longitudinally-extending and transversely concave member adapted for positioning between said sheets, said concave member having longitudinally-extending feathered edges for abutting relation with said sheets;

means for anchoring said effecting means against said sheets, said anchoring means comprising means, attached to said concave member, for engaging a putty-like material placed in a corner formed by said perpendicularly-disposed sheets; and tape means, bonded to said effecting means, for overlapping and bonding to said sheets, whereby a smooth transition is achieved between said effecting means and said sheets, said tape means comprising a piece of tape extending longitudinally along said concave member and transversely past said feathered edges, whereby said concave member is held by said engaging means against said putty-like material placed in said corner, with said feathered edges and said tape effecting a smooth transition between said concave member and said sheets.

3. A corner strip as defined in claim 2 wherein:

said anchoring means comprises at least one arrow-like member projecting toward said corner, said arrow-like member longitudinally extending along at least a portion of said concave member and piercing and engaging said putty-like material placed in said corner to affix said concave member to said corner; and said effecting means further comprises means for positioning said concave member centrally within said corner.

4. A corner strip as defined in claim 3, wherein said positioning means comprises:

a pair of supporting plates extending inwardly from said feathered edges toward said corner and extending longitudinally along at least a portion of said concave member in parallel relation to said sheets, whereby the positioning of said plates against said sheets centrally positions said concave member in said corner.

5. A corner strip as defined in claim 3, wherein said anchoring means comprises:

a pair of parallel arrow-like members extending longitudinally along substantially the entire length of said concave member, said arrow-like members piercing and engaging said putty-like material.

6. A corner strip as defined in claim 2, wherein:

said sheets comprise drywall sheets;

said putty-like material comprises drywall topping compound; and said tape means comprises a strip of drywall tape attached to said concave member, whereby said concave member is positioned between said two perpendicularly-disposed drywall sheets forming said corner, said corner being filled with said compound, with said anchoring means affixing of said convex member to said drywall compound, and with said drywall tape lapping said concave member to said sheets.

7. A corner strip for two perpendicularly-disposed wallboard sheets, comprising:

means, disposed between said sheets, for effecting a curvilinear transistion from one of said sheets to the other of said sheets, said engaging means comprising a longitudinally-extending and transversely convex member adapted for positioning between said sheets with said sheets in spaced-apart relation;

means for anchoring said effecting means against said sheets, said anchoring means comprising means, extending longitudinally along at least a part of said convex member, for engaging the edges of said sheets; and tape means, bonded to said effecting means, for overlapping and bonding to said sheets, whereby a smooth transition is achieved between said effecting means and said sheets, said tape means comprising a piece of tape extending the length of said convex member and past said edges, whereby said convex member is held by said engaging means in the corner formed by two perpendicularly-disposed and spaced-apart sheets, with said tape effecting a smooth transition between said convex member and said sheets.

8. A corner strip as defined in claim 7, wherein said engaging means comprises:

a pair of open channels extending longitudinally along said convex member, said channels each comprising a first member perpendicular to the longitudinal edge of said convex member, and a second member perpendicular to said first member, said first and second members thereby forming right-angle open channels along each of said longitudinal edges for receiving edge portions of said sheets, with said second member of each channel being positioned beneath its respective sheet edge and with said first member having a width of approximately equal to the thickness of its respective sheet edge, whereby said longitudinal edges of said convex member are immediately adjacent to the outer surfaces of said edges of said sheets, with said tape means covering said edges of said convex member and said edges of said sheets to effect a smooth transition from said convex member to said sheets.

9. A corner strip as defined in claim 8, wherein:

said sheets comprise drywall sheets perpendicularly-disposed in spaced-apart relation; and said tape means comprises drywall tape attached to said convex member, whereby said convex member is positioned between said two drywall sheets, with said convex member being affixed to said sheets by said open channels, and with said drywall tape smoothly lapping the edges of said convex member to said sheets.

10. A corner piece for two perpendicularly-disposed drywall sheets comprising:

rigid means, disposed between said sheets, for effecting a curved transition from one of said sheets to the other of said sheets, said rigid means comprising a longitudinally-extending and transversely concave member positionable in the corner formed by said two perpendicularly-disposed sheets, with said sheets in mutually abutting relation;

means for holding said rigid means against said sheets, said holding means comprising at least one arow-like member extending towards said corner from said concave member, said arrow-like member adapted to engage drywall topping compound material placed in said corner; and tape means, attached to said rigid means, for lapping the transverse edges of said rigid means to said sheets, thereby effecting a uniform transition from said rigid means to said sheets, said tape means comprising a piece of drywall tape extending the length of said convex means and overlapping said sheets, whereby said concave member is held by said arrow-like members in said compound placed in said corner, with said tape being bonded to said sheets to effect a smooth transition between said sheets and said concave member.

11. A corner piece as defined in claim 10, wherein said rigid means further comprises:

a pair of supporting plates extending inwardly from said transverse edges of said concave member towards said corner, said supporting plates longitudinally extending along at least a portion of said concave member in parallel relation to said sheets, whereby the positioning of said plates against said sheets centrally positions said concave member in said corner.

12. A corner piece for two perpendicularly-disposed drywall sheets comprising:

rigid means, disposed between said sheets, for effecting a curved transition from one of said sheets to the other of said sheets, said rigid means comprising a longitudinally-extending and transversely convex member positionable in the corner formed by said two perpendicularly-disposed sheets with said sheets positioned in spaced-apart relation;

means for holding said rigid means against said sheets, said holding means comprising a pair of open channels longitudinally extending along the transverse edges of said convex member, said channels receiving the edge portions of said dry wall sheets whereby said convex member is held to said sheets by said channels; and tape means, attached to said rigid means, for lapping the transverse edges of said rigid means to said sheets, thereby effecting a uniform transition from said rigid means to said sheets, said tape means comprising a piece of drywall tape extending the length of said convex member and overlapping said edge portions of said sheets, whereby said convex member is held by said channels in said corner, with said tape effecting a smooth transition between said convex member and said sheets.

13. A corner strip for two perpendicularly-disposed wallboard sheets for forming a corner, comprising:

rigid means, disposed between said sheets, for effecting a curvilinear transition from one of said sheets to the other of said sheets, said rigid means comprising a longitudinally-extending and inwardly rounded member adapted for positioning between said sheets;

means, attached to said inwardly rounded member, for engaging a putty-like material placed in said corner;

a pair of supporting plates, extending inwardly from the edges of said inwardly-rounded member toward said corner and longitudinally extending along at least a portion of said rounded member in parallel relation to said sheets, whereby the positioning of said plates against said sheets centrally positions said rounded member in said corner; and tape means, bonded to said rounded member, for overlapping said sheets, whereby smooth transition is achieved between said rounded member and said sheets.

* * * * *